US009001627B2

(12) United States Patent
Giguet

(10) Patent No.: US 9,001,627 B2
(45) Date of Patent: Apr. 7, 2015

(54) DISPLAY MODULE OF A TIMEPIECE

(75) Inventor: Denis Giguet, Saint Martin Bellevue (FR)

(73) Assignee: Harry Winston S.A., Plan-les-Quates (CH)

( * ) Notice: Subject to any disclaimer, the term of this patent is extended or adjusted under 35 U.S.C. 154(b) by 17 days.

(21) Appl. No.: 14/004,470

(22) PCT Filed: Mar. 14, 2012

(86) PCT No.: PCT/IB2012/000472

§ 371 (c)(1),
(2), (4) Date: Nov. 18, 2013

(87) PCT Pub. No.: WO2012/123806

PCT Pub. Date: Sep. 20, 2012

(65) Prior Publication Data

US 2014/0086025 A1 Mar. 27, 2014

(30) Foreign Application Priority Data

Mar. 14, 2011 (CH) ..... 00426/11

(51) Int. Cl.

| | |
|---|---|
| ***G04B 19/00*** | (2006.01) |
| ***G04C 21/00*** | (2006.01) |
| ***G04B 19/02*** | (2006.01) |
| ***G04B 25/00*** | (2006.01) |
| ***G04C 17/00*** | (2006.01) |
| ***G04B 19/06*** | (2006.01) |
| ***G04B 19/04*** | (2006.01) |
| ***G04B 45/00*** | (2006.01) |
| ***G09F 23/16*** | (2006.01) |

(52) U.S. Cl.

CPC ..... *G04B 19/04* (2013.01); *G04B 19/00* (2013.01); *G04B 45/0038* (2013.01); *G09F 23/16* (2013.01)

(58) Field of Classification Search

USPC ..... 368/76, 220–223, 228, 229, 231–233
See application file for complete search history.

(56) References Cited

U.S. PATENT DOCUMENTS 3,846,926 A * 11/1974 Sullivan ..... 40/474
4,583,864 A 4/1986 Graves
4,884,256 A * 11/1989 Blackburn ..... 368/223

(Continued)

FOREIGN PATENT DOCUMENTS

EP 1 705 535 A1 9/2006

*Primary Examiner* — Amy Cohen Johnson
*Assistant Examiner* — Daniel Wicklund
(74) *Attorney, Agent, or Firm* — Sughrue Mion, PLLC

(57) ABSTRACT

The invention concerns a timepiece display module intended to display a series of alphanumerical characters and/or pictures at different moments. The display module includes a platform (3) arranged to be actuated in rotation about an axis and several wheel sets (5) arranged on the platform (3) so that each wheel set (5) turns on itself while orbiting about the axis of rotation of said platform (3) when the latter is actuated in rotation. The display module further includes several wings (1) which are arranged on each wheel set so (5) as to be positioned in turn at the center of the display module. Each wing (1) of each wheel set (5) is actuated such that the wings are oriented in a identical plane at the center of the display module and are adjacent to each other so as to form a central display unit (2). Each wing (1) includes one portion of an alphanumerical character or picture so that the central display unit (2), formed of several wings (1), can display, at each moment, one of the alphanumerical characters and/or pictures.

9 Claims, 5 Drawing Sheets

(56) References Cited

U.S. PATENT DOCUMENTS

| | | | | |
|---|---|---|---|---|
| 4,941,137 | A * | 7/1990 | Kikuchi | 368/223 |
| 5,109,989 | A * | 5/1992 | Kremmin et al. | 211/1.55 |
| 6,229,768 | B1 * | 5/2001 | Nakazawa et al. | 368/223 |
| 6,262,947 | B1 * | 7/2001 | Pulver | 368/223 |
| 7,420,885 | B2 * | 9/2008 | Claret et al. | 368/223 |
| 7,480,213 | B2 * | 1/2009 | Muraji | 368/223 |
| 7,839,727 | B2 * | 11/2010 | Buttet et al. | 368/223 |
| 2005/0276168 | A1 * | 12/2005 | Conus et al. | 368/220 |
| 2011/0069590 | A1 * | 3/2011 | Jolidon | 368/224 |
| 2014/0016445 | A1 * | 1/2014 | Claret et al. | 368/229 |
| 2014/0313868 | A1 * | 10/2014 | Takematsu et al. | 368/232 |

* cited by examiner

DISPLAY MODULE OF A TIMEPIECE

CROSS REFERENCE TO RELATED APPLICATIONS

This application is a National Stage of International Application No. PCT/IB2012/000472 filed Mar. 14, 2012, claiming priority based on Switzerland Patent Application No. 11-00426 filed Mar. 14, 2011, the contents of all of which are incorporated herein by reference in their entirety.

FIELD OF THE INVENTION

The present invention relates to the field of horology, and more specifically to a display module for a timepiece.

BACKGROUND OF THE INVENTION

There exist state-of-the-art mechanical watches including display devices, particularly time display devices, which possess original features distinguishing them from conventional analogue displays, which usually include an hour hand coaxial with a minute hand at the centre of the movement.

By way of example, Swiss Patent Application No 01949/07 (unpublished) discloses a timepiece display device comprising several elongated prisms. Each prism is capable of being actuated to pivot in rotation about its longitudinal axis, enabling one of the lateral faces thereof to be oriented in a display plane, so that, viewed together, all of the lateral faces displayed provide information relating to the legal time. Close to its periphery, the display device includes several display modules; each display module including several elongated prisms arranged side-by-side lengthwise so as to form a display surface. The visual appearance of each lateral face of each prism of each module is devised to enable the legal time information to be recreated on the display surface of one of the display modules when the prisms of that module are oriented side-by-side in the display plane. The display device further includes a rotating member arranged coaxially at the centre of the movement, said rotating member being capable of revealing, by rotating about its axis, one of the display modules corresponding to the legal time.

It is an object of the present invention to propose another original display device for indicating, in particular, the hours.

SUMMARY OF THE INVENTION

According to the invention, this object is achieved via a timepiece display module intended to display a series of alphanumerical characters and/or pictures at different times. The display module includes a platform arranged to be actuated in rotation about an Axis and several wheel sets arranged on the platform so that each wheel set turns on itself while orbiting about the axis of rotation of said platform when the latter is actuated in rotation. The display module further includes several wings which are arranged on each wheel set so as to be positioned in turn at the centre of the display module. Each wing of each wheel set is actuated such that the wings are oriented in a substantially identical plane at the centre of the display module and are adjacent to each other so as to form a central display unit. Each wing includes one portion of an alphanumerical character or picture so that the central display unit, formed of several wings, can display, at any time, one of the alphanumerical characters and/or pictures.

Preferably, the display module according to the invention is intended to display, in series on the central display unit, the numbers 1 to 12 representing the hours. For this purpose, the module includes four wheel sets each including six wings, which each have on both faces thereof one portion of the numbers from 1 to 12.

BRIEF DESCRIPTION OF THE DRAWINGS

The features of the invention will appear more clearly upon reading the description of a preferred embodiment, given solely by way of non-limiting example with reference to the schematic drawings, in which.

DETAILED DESCRIPTION OF THE PREFERRED EMBODIMENTS

Figure 1:
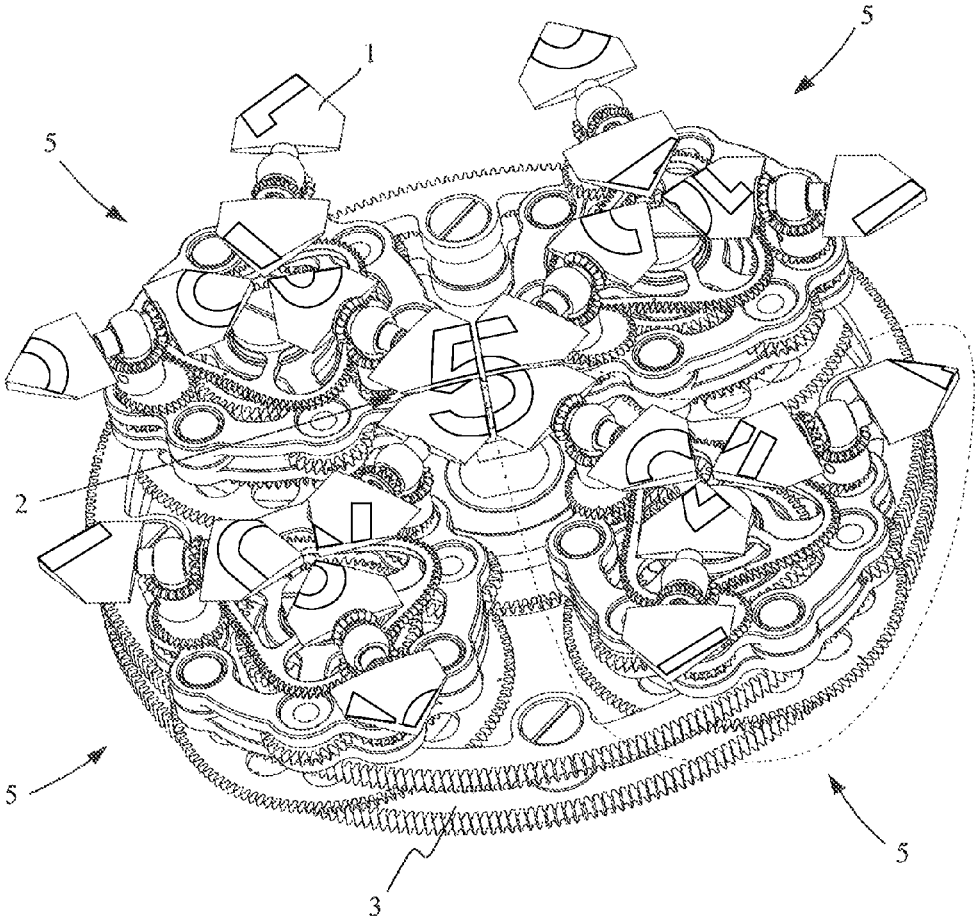
FIG. 1 is a perspective top view of an hour display module according to the invention.

According to the preferred embodiment of the invention the display module illustrated in FIG. 1 is devised to recreate at the centre thereof the numbers "1", "2", "3", "4", "5", "6", "7", "8", "9", "10", "11" and "12" in series by means of four wings 1. For this purpose, each of wings 1 of the display module is capable of pivoting about a pivot axis to enable one or other of the faces thereof to be made visible. Each wing 1 has two lateral sides, parallel to each other and symmetrical with respect to the pivot axis of the wing. Each lateral side of the wing is extended by an inclined side to form a triangular part having an apex angle of 90° which coincides with the pivot axis of the wing. This particular shape enables four wings to be positioned each hour at the centre of the display module where each inclined side of each wing is juxtaposed with one of the inclined sides of two other wings to form the central display unit 2. In order to recreate, in series, the numbers 1 to 12 representing the hours by means of four wings, the display module has a total of 24 wings, which each include on both faces thereof a fraction of one of the numbers 1 to 12 (not shown). Indeed, in order to recreate the numbers 1 to 12 by means of four wings, there must be 48 fractions of the numbers (4×12) which are distributed over the two faces of each wing (24×2).

The complexity of the invention lies in the movement to be imparted to the wings since:

- four wings must be positioned once every six hours in a substantially identical plane at the centre of the display module;
- the four wings must be oriented in relation to each other so that there is a 90° angle between the pivot axis of each wing, in order for the wings to be adjacent to each other to form the central display unit 2;
- each wing must complete a 180° rotation about its axis 16 so that the first fraction of a number arranged on one of the faces thereof is visible for one hour at the centre of the display module, and so that the second fraction of another number arranged on the other face thereof is visible for one hour when the wing is repositioned at the centre of the display module six hours later.

Figure 2:
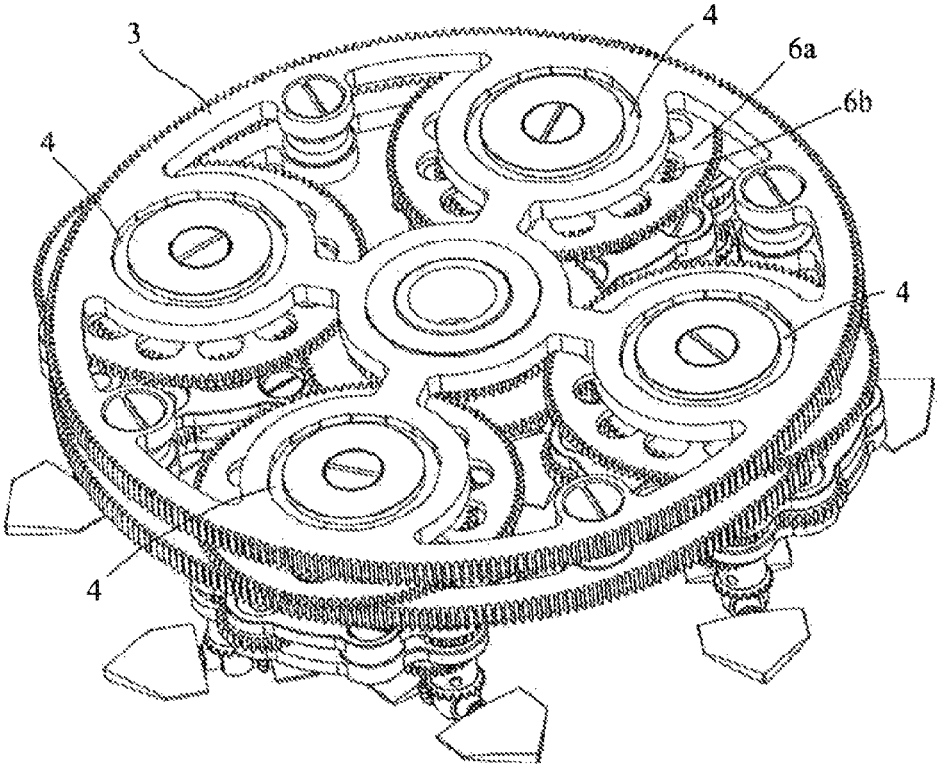
FIG. 2 is a perspective bottom view of FIG. 1.
Figure 3:
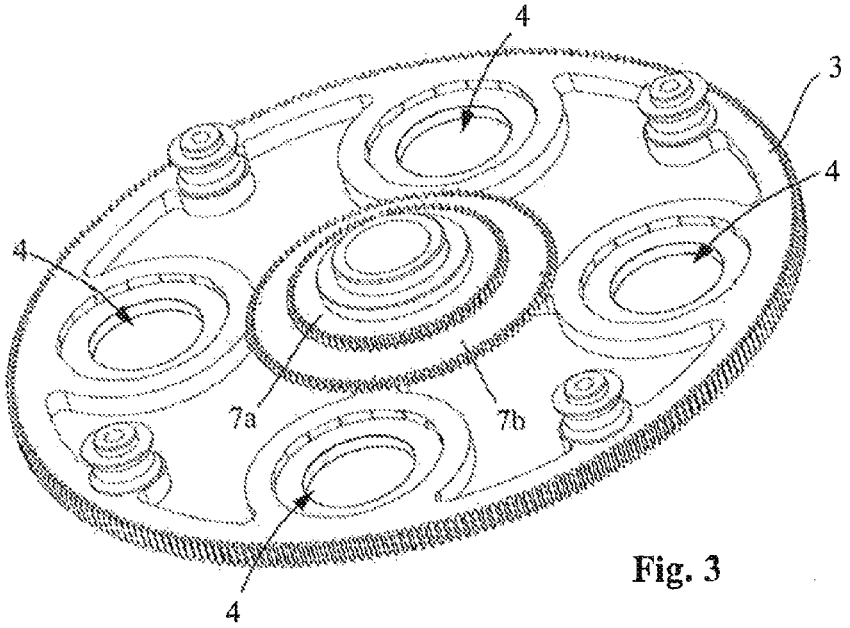
FIG. 3 is a perspective view of one part of the platform.
Figure 4:
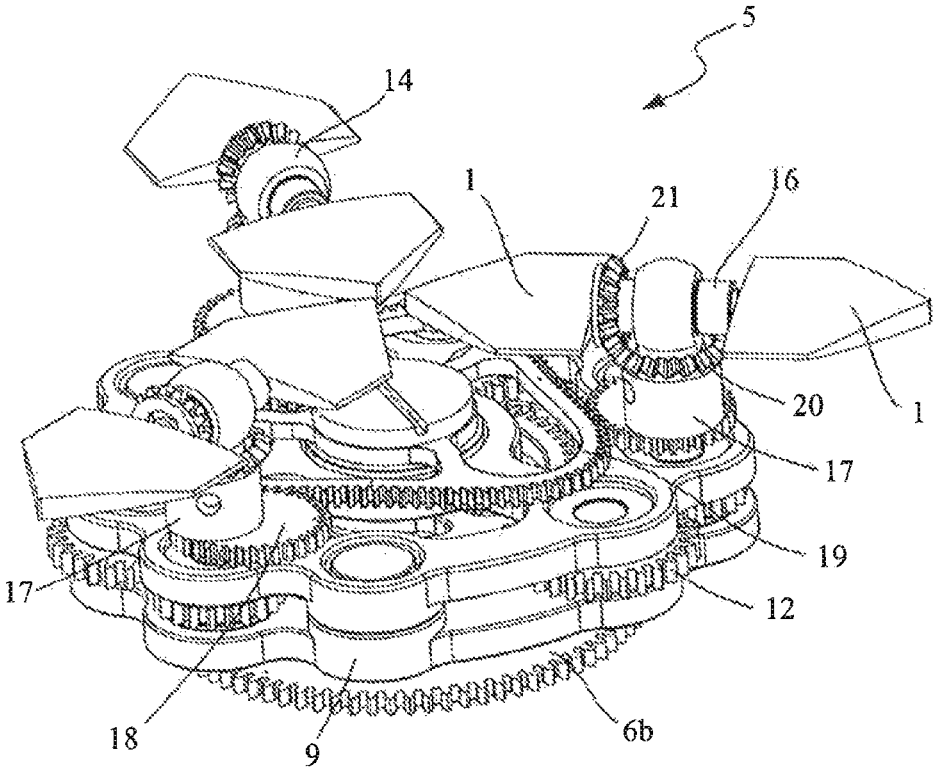
FIG. 4 shows a complete perspective view of one of the wheel sets of the hour display module.

To achieve this specific mode of driving the wings, the module has a platform 3 (FIG. 3) provided with four receptacles 4 arranged at 90° from each other, and each intended to receive a wheel set 5 (FIG. 4). Referring now to FIG. 2, each wheel set 5 includes a first and a second satellite wheel 6*a*, 6*b* which are coaxial and respectively meshed with a first and a second planetary wheel 7*a*, 7*b* (FIG. 3) on which platform 3 is pivotally mounted. Platform 3 has a toothing over its entire circumference enabling the platform to be driven 90° in rotation once per hour by a drive device which will be described below. The gear ratios are determined so that the first and second satellite wheels 6*a*, 6*b* complete one rotation respectively of 60° and of 120° every hour during the 90° rotation of platform 3.

Figure 5:
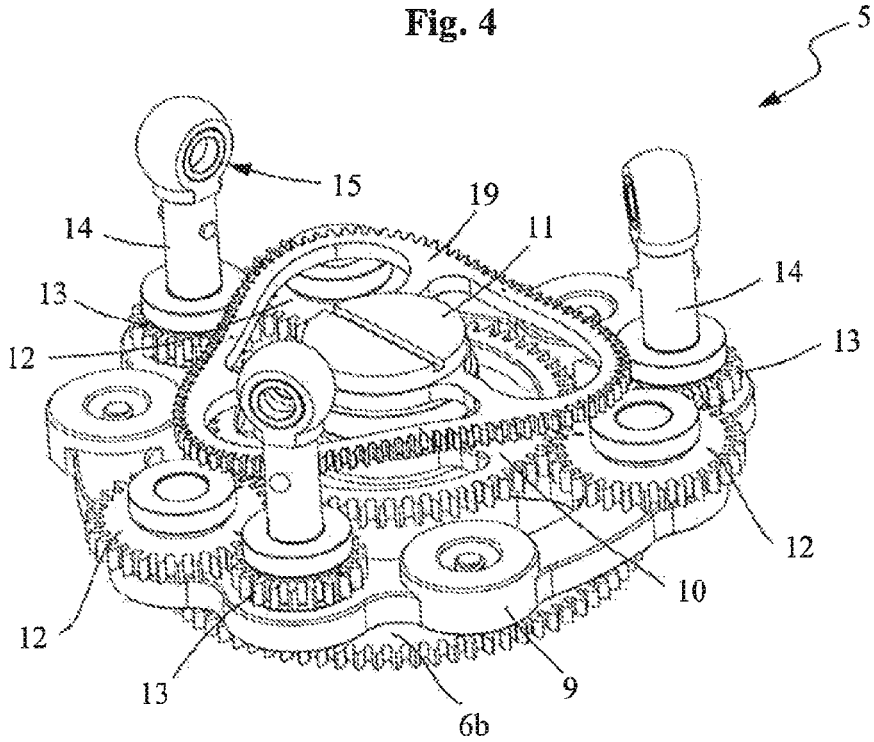
FIG. 5 is a partial perspective view of FIG. 4.

In FIG. 5, each wheel set 5 includes a frame 9, which is secured to the second satellite wheel 6*b* and on which an epicyclic train is arranged. The train is formed of a planetary wheel 10, which is arranged at the centre of frame 9 and secured to an arbour 11, which is kinematically connected to the first satellite wheel 6*a* so that planetary wheel 10 makes a 60° rotation during the hour change. Planetary wheel 10 is meshed with three intermediate wheels 12, which each mesh with a satellite wheel 13 so that each satellite wheel makes a 180° rotation relative to frame 9 during the hour change when platform 3 is driven through 90°.

A wing carrier 14, in the form of a pin, is mounted on each satellite wheel 13 along the axis of rotation thereof and, at the top end, has an orifice 15 inside which an arbour 16 is fitted (FIG. 4), which includes a wing 1 at each end thereof.

In order to position, in turn, one wing of each wheel set 5 at the centre of the display module every hour, the four wheel sets move orbitally through 90° when platform 3 is actuated to rotate through 90° for a period which is set by the display module drive device and is preferably between five and ten seconds. During this time period, frame 9 makes a 120° rotation on itself while the three wing carriers 14 each make a 180° rotation relative to frame 9.

One of the major difficulties that the invention proposes to overcome concerns the movement that has to be imparted to each wing 1 for the wings to make a rotation on their axis 16 so that the first fraction of a number arranged on one of the wing faces is visible for one hour at the centre of the display module, and so that the second fraction of another number arranged on the other wing face is visible for one hour when the wing is repositioned at the centre of the display module six hours later. This allows the numbers 1 to 12 to be displayed in series on central display unit 2 while preventing any collision between the wings during the hour change.

For this purpose, referring now to FIG. 4, a cylinder 17 is pivotally mounted about each wing carrier 14. One of the ends of cylinder 17 is integral with an elliptical gear 18, which is meshed with a wheel set 19, which has a particular toothing over its entire periphery. The other end of cylinder 17 includes a first conical pinion 20, which is arranged to drive a second conical pinion 21 mounted on arbour 16 of wing carrier 14.

The geometry of wheel set 19 and of elliptical gears 18 is set so as to cause a variation in gear ratio so that, every hour, each wing turns twice, respectively three times alternately about its pivot axis so as to display the numbers 1 to 12 in series. More specifically, the circumference of wheel set 19 is the result of a mathematical relation providing the best possible rotation. Elliptical gears 18 are arranged at 120° from each other, so that each gear 18 meshes with one of the three rectilinear segments of wheel set 19 during an hour change, and then with one of the curved segments of said wheel set 19 during the next hour change (one unit incrementation of the hours). When elliptical gear 18 moves along the rectilinear segment, respectively the curved segment of wheel set 19, cylinder 17 pivots through 144°, 216° respectively about its axis. The gear ratios between the two conical pinions 20, 21 are determined so that the wings of each carrier 14 make one revolution about their pivot axis during the hour change, then one and a half revolutions during the next hour change. Given that each wing is repositioned at the centre of the display module every six hours, during that time period, the wing will thus have made 7.5 revolutions about arbour 16. This means that each wing can be oriented so that both of the faces thereof are visible at the centre of the module for one hour, at six hour intervals.

The profile of the toothings of wheel set 19 and of elliptical gears 18 is obtained by means of Pro/ENGINEER™ type software, whose calculation capacity is currently able to design virtual gears formed of "wheels" of quite extreme shapes and to analyse various parameters such as angular play and yield on the meshing of a tooth of a given shape. It is possible nowadays to manufacture these "wheels" in particular using a deep photolithography method.

The table below summarises the movements imparted to the essential elements of the display module after every hour:

| Hour | Satellite wheel | | Wing | |
|---|---|---|---|---|
| display | carrier | Frame | Carrier 14 | Arbour 16 |
| 1 | 0° | 0° | 0°/Wing 1 | 0°/face 1 |
| 2 | 90° | 120° | 180° | 1 revolution/ face 1 |
| 3 | 180° | 240° | 360° | 2.5 revolutions/face 2 |
| 4 | 270° | 360° (1 revolution) | 180°/Wing 2 | 3.5 revolutions/face 2 |
| 5 | 360° (1 revolution) | 480° | 720° face 1 | 5 revolutions/ |
| 6 | 450° | 600° | 900° | 6 revolutions/ face 1 |
| 7 | 540° | 720° (2 revolutions) | 0°/Wing 1 | 7.5 revolutions/face 2 |
| 8 | 630° | 940° | 1260° | 8.5 revolutions/face 2 |
| 9 | 720° (2 revolutions) | 1060° | 1440° | 10 revolutions/face 1 |
| 10 | 810° | 1180° (3 revolutions) | 180°/Wing 2 | 11 revolutions/face 1 |
| 11 | 900° | 1300° | 1800° | 12.5 revolutions/face 2 |
| 12 | 990° | 1420° | 1980° | 13.5 revolutions/face 2 |
| 1 | 1080° (3 revolutions) | 1640° (4 revolutions) | 0° (2160° C.) | 15 revolutions/face 1 |

According to this Table, frame 9 of each wheel set 5 makes one complete revolution on itself in the space of three increments of the hour display when platform 3 performs three-quarters of a revolution. During this time period, carrier 14 makes one and a half revolutions and positions both of the wings of each carrier at the centre of the module for one hour, at three hour intervals. Finally, the pivot arbour 16 of the wings respectively makes 7.5 and 15 revolutions during six, respectively twelve incrementations of the hours so that the first fraction of a number arranged on one of the faces of each wing is visible for one hour at the centre of the display module, and so that the second fraction of another number arranged on the other face thereof is visible for one hour when the wing is repositioned at the centre of the display module six hours later.

In order for the display module to be actuated every hour to perform the hour change, a release mechanism is arranged to drive platform 3 through a 90° rotation every hour. Thus, the mechanism of FIG. 6 includes a barrel 30 whose arbour is connected to the cannon-pinion 31 which enables the energy necessary for actuating the display module to be stored in the mainspring for one hour. The barrel drum is intended to be meshed with platform 3 which includes a toothing on the circumference thereof (FIGS. 1 to 3). The mechanism further includes a release wheel 32 which is kinematically connected to barrel 30 by a ratio of one via a wheel set 33 so that release wheel 32 also makes one revolution per hour.

Figure 7:
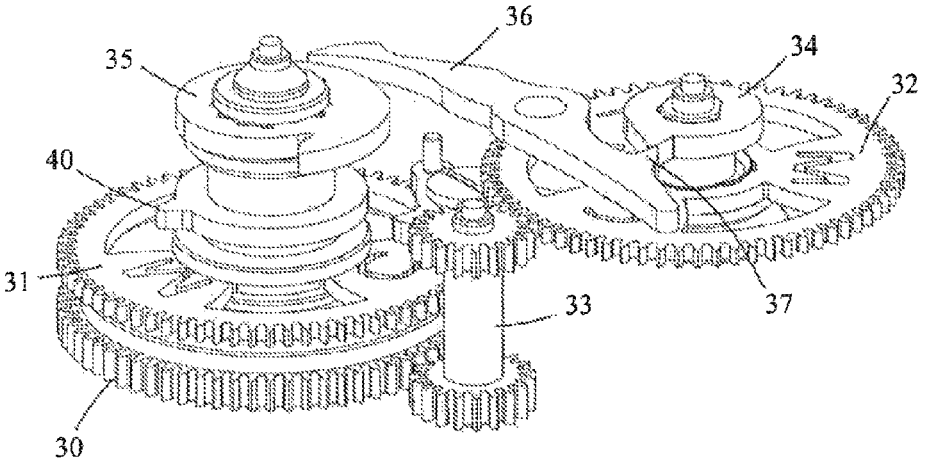
FIG. 7 is a perspective bottom view of FIG. 6.

Referring now to FIG. 7, a cam 34 is secured to release wheel 32, while a snail is driven onto the cannon-pinion. A release lever 36 is arranged to be in permanent contact with snail 35 and includes an edge 37 arranged to abut against a radial flank of cam 34. The rotation of snail 35 gradually tips lever 36 about its pivot axis so that edge 37 moves along the radial flank of cam 34 for one hour until it is completely released from said cam 34. At that moment, the cam is no longer locked by lever 36 thereby releasing barrel drum 30. The rotation of the barrel drum drives release wheel 32 which makes one revolution until edge 37 of lever 36 again abuts against the radial flank of cam 34. Since the ratio between release wheel 32 and barrel 30 is one, the barrel also makes a 360° rotation every hour to drive platform 3 through 90°.

Figure 6:
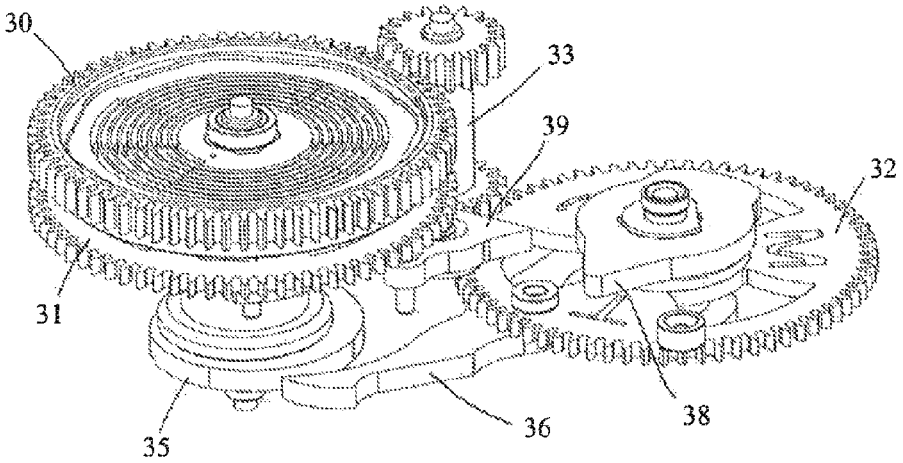
FIG. 6 is a perspective top view of a release mechanism of the display module of FIG. 1.

In FIG. 6, a first finger 38 is fixed to the arbour of release wheel 32 and is arranged to actuate a lifting piece 39 which lies on the trajectory of a second finger 40 (FIG. 7), which is pivotally connected to cannon-pinion 31. The object of this mechanism is to reduce the adjustment time for the watchmaker. Release lever 36 may thus be arranged so that edge 37 is ahead on the "high point" of the release cam 32 relative to the contact point of lever 36 on the "high point" of snail 35. When edge 37 of lever 36 is released once per hour from cam 34, release wheel 32 is driven in rotation in unison with first finger 38 which strikes lifting piece 39. Lifting piece 39 then actuates second finger 40 in rotation which drives snail 35, thereby enabling lever 36 to pass over the high point of the snail. When lever 36 has finished its jump, a return spring (not illustrated) returns the elements to their original positions. Without this mechanism, the "high point" of snail 35 would have to be exactly adjusted to the "high point" of cam 34 on lever 36.

Figure 8:
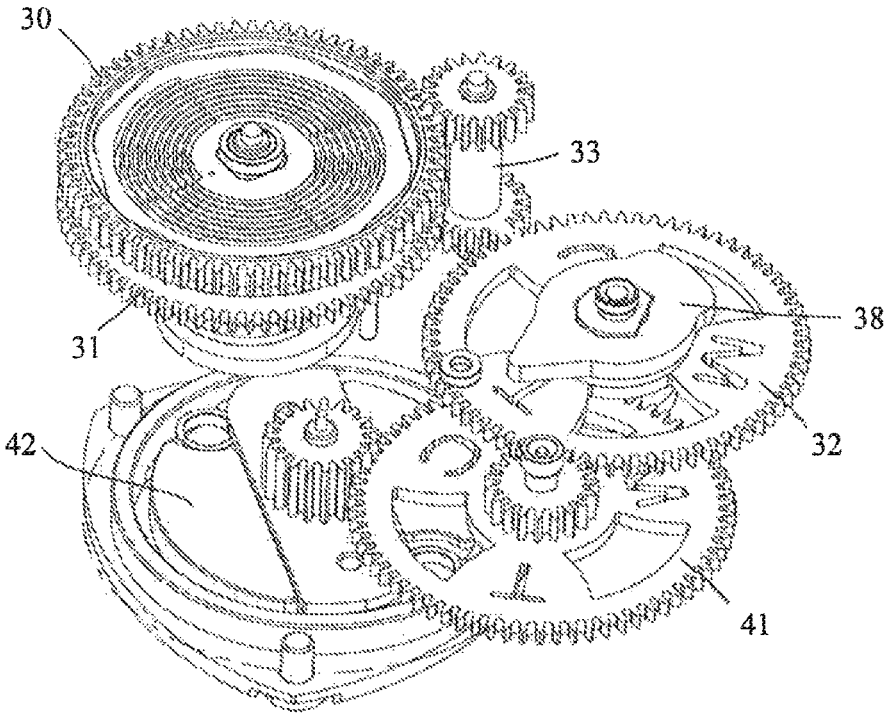
FIG. 8 is a perspective view of the mechanism of FIGS. 6 and 7 coupled to a governor.

To control and optimise the kinematic energies present, an inertia governor 42 is connected to release wheel 32 by means of an intermediate wheel 41 (FIG. 8) so that barrel drum 30 makes a 360° rotation within the space of a period of preferably between six and eight seconds.

It goes without saying that the invention is not limited to the preferred embodiment described above but that it covers all the variant embodiments. By way of example, the wings may each include a portion of a picture in order to recreate different pictures at different times.

The invention claimed is:

1. A timepiece display module intended to display a series of alphanumerical characters and/or pictures at different moments, the display module including a platform arranged to be actuated in rotation about an axis, several wheel sets arranged on the platform so that each wheel set rotates on the central axis thereof while orbiting about the axis of rotation of said platform when said platform is actuated in rotation, the display module further including several wings arranged on each wheel set to be positioned in turn at the center of the display module, each wing of each wheel set being actuated so that said wings are oriented in a substantially identical plane at the center of the display module and are adjacent to each other so as to form a central display unit, each wing including one portion of an alphanumerical character or picture so that the central display unit, formed by several wings can display, at each moment, one of the alphanumerical characters and/or pictures.

2. The display module according to claim 1, including four wheel sets each including six wings, which include on both faces thereof one portion of an alphanumerical character or picture.

3. The display module according to claim 1, wherein the central display unit is intended to display, in series, the numbers 1 to 12 representing the hours.

4. The display module according to claim 1, wherein each wheel set includes a first and a second satellite wheel which are coaxially mounted and respectively mesh with a first and a second planetary wheel on which the platform is pivotally mounted.

5. The display module according to claim 4, wherein each wheel set includes a frame on which there is mounted an epicyclic train, which includes three satellite wheels meshed with a planetary wheel, each satellite wheel being integral with a wing carrier, which is mounted along the axis of rotation of the corresponding satellite wheel, and carries an arbour traversing the carrier perpendicularly and at the ends of which there are arranged two wings.

6. The display module according to claim 5, wherein the planetary wheel of the epicyclic train and the frame of each wheel set are respectively connected to the first and to the second satellite wheel of the corresponding wheel set.

7. The display module according to claim 5, wherein the gear ratios between the second satellite wheel and the second planetary wheel are set such that the frame makes one 120° revolution when the platform is driven through a 90° rotation.

8. The display module according to claim 5, wherein the gear ratios between the planetary wheel and the three satellite wheels of the epicyclic train of each wheel set are set such that each of the three satellite wheels makes a 180° rotation relative to the frame when the platform is driven through a 90° rotation.

9. A wristwatch including a display module according to claim 1.

* * * * *